US008707645B1

(12) United States Patent
Boeshart

(10) Patent No.: US 8,707,645 B1
(45) Date of Patent: Apr. 29, 2014

(54) FORM SYSTEM FOR POURED CONCRETE

(71) Applicant: Patrick E Boeshart, Sioux City, IA (US)

(72) Inventor: Patrick E Boeshart, Sioux City, IA (US)

( * ) Notice: Subject to any disclaimer, the term of this patent is extended or adjusted under 35 U.S.C. 154(b) by 0 days.

(21) Appl. No.: 14/065,896

(22) Filed: Oct. 29, 2013

(51) Int. Cl.
*E04C 1/00* (2006.01)
*E04B 5/36* (2006.01)
*E04B 5/32* (2006.01)

(52) U.S. Cl.
CPC .. *E04B 5/36* (2013.01); *E04B 5/326* (2013.01)
USPC ..... 52/309.12; 52/415; 52/425

(58) Field of Classification Search
CPC ..... E04B 5/026; E04B 5/02; E04B 5/04; E04B 5/046; E04B 5/17; E04B 5/18; E04B 5/19; E04B 5/32; E04B 5/326; E04B 5/36
USPC ..... 52/309.6, 309.7, 309.12, 783.1, 52/319–328, 415, 419, 421, 422, 424, 425, 52/434, 437–439; 249/29–30, 102, 83
See application file for complete search history.

(56) References Cited

U.S. PATENT DOCUMENTS

| | | | | |
|---|---|---|---|---|
| 4,889,310 | A * | 12/1989 | Boeshart | 249/41 |
| 6,272,749 | B1 * | 8/2001 | Boeshart et al. | 29/897.32 |
| 6,298,622 | B1 * | 10/2001 | Cretti | 52/309.7 |
| 6,817,150 | B1 | 11/2004 | Boeshart | |
| 7,810,293 | B2 * | 10/2010 | Gibbar et al. | 52/309.7 |
| 8,015,771 | B2 * | 9/2011 | LeBlang | 52/414 |

* cited by examiner

*Primary Examiner* — Mark Wendell
(74) *Attorney, Agent, or Firm* — Sturm & Fix LLP

(57) ABSTRACT

A method and apparatus using foam forms for poured concrete roof and floor decks for on-site concrete structural joists is shown that may be integrated into the concrete deck formed by the forms or otherwise used as structural supports. Greater joist strength results from providing a communication channel in the forms between an opening in C channel metal studs used in such panel forms and a space between piers that forms the main concrete beam portion of a finished concrete structural joist. By providing such flow of concrete, when the joist is completed, the concrete structural joint is stronger because the concrete is disposed inside of the C channel studs and continuously between the inside of the C channel studs and the main concrete beam portion. The concrete thereby interlocks the C channels to the main concrete portion of beam.

6 Claims, 4 Drawing Sheets

Fig. 6
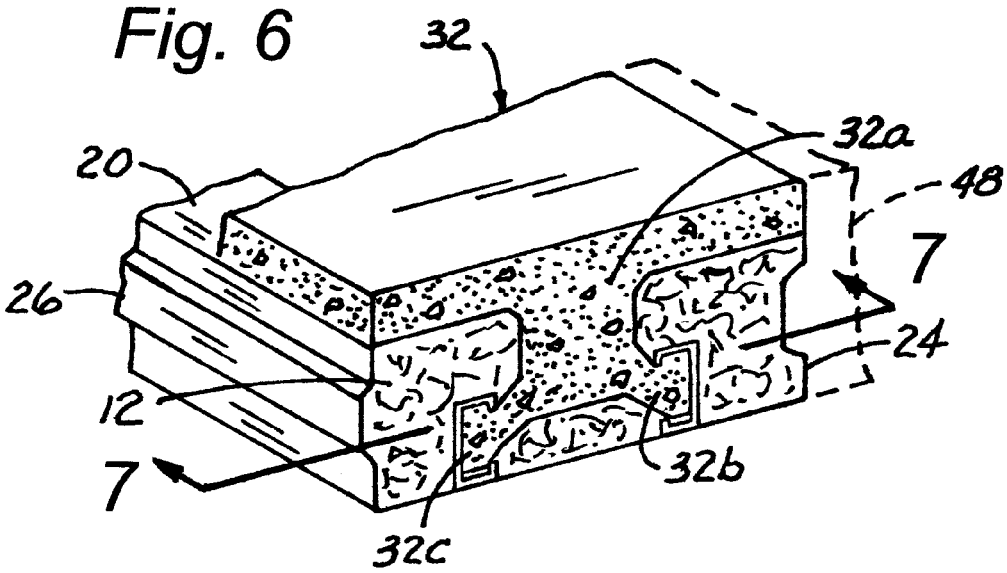
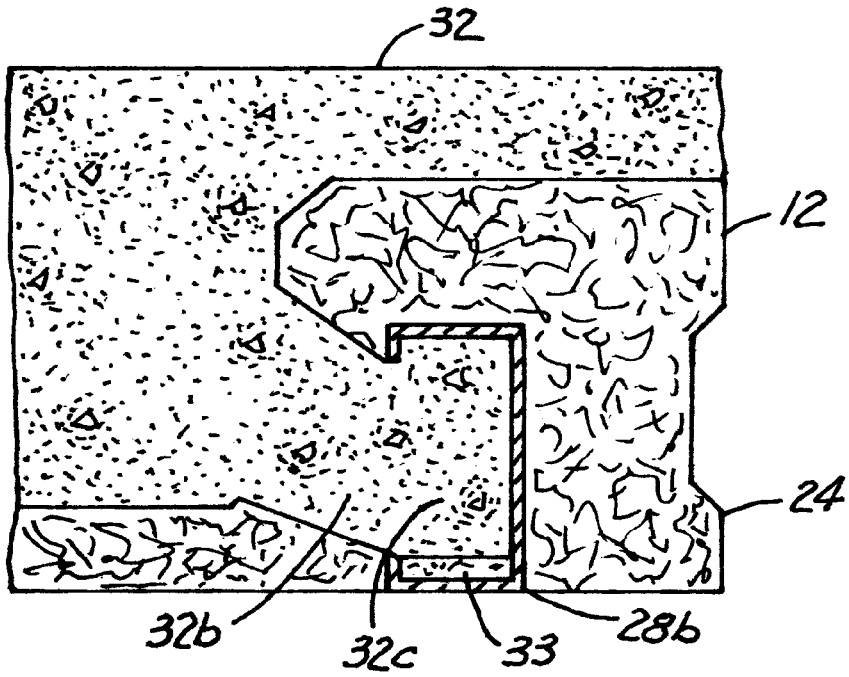
Fig. 7

FORM SYSTEM FOR POURED CONCRETE

BACKGROUND OF THE INVENTION (1) Field of the Invention

The present invention relates generally to forms for poured concrete roof and floor decks, and more particularly to an improved form system for on-site concrete structural joists that may be integrated into the concrete deck formed by the forms or otherwise used as structural supports.

(2) Background Information

It is well known in the construction industry to utilize expanded plastic material for forms used in the construction of poured concrete walls, joists and the like. In the formation of walls or joists, the expanded plastic forms may either be removed once the concrete has hardened, or left in place to provide thermal and sound insulation to the completed structure. U.S. Pat. No. 6,817,150 to Boeshart, which is incorporated herein by reference in its entirety, is one example of such a system.

In the field of construction of concrete structural joists there exists a desire to make such joists as strong as possible while at the same time keeping the cost of making such joists as low as possible.

SUMMARY OF THE INVENTION

The present invention relates to a method and apparatus using foam forms for poured concrete roof and floor decks, and more particularly to an improved form system for on-site concrete structural joists that may be integrated into the concrete deck formed by the forms or otherwise used as structural supports. The present invention is an improvement over prior art systems of this general type by providing a communication channel in the forms between an opening in C channel metal studs used in such panel forms and a space between piers that forms the main concrete beam portion of a finished concrete structural joist. By providing such flow of concrete, when the joist is completed, the concrete structural joint is stronger because the concrete is disposed inside of the C channel studs and continuously between the inside of the C channel studs and the main concrete beam portion. The concrete thereby interlocks the C channels to the main concrete portion of beam.

BRIEF DESCRIPTION OF THE DRAWINGS

The above mentioned needs are at least partially met through provision of the apparatus described in the following detailed description, particularly when studied in conjunction with the drawings, wherein:

FIG. 6 is a partial perspective view of the form of FIGS. 1-5 after the concrete has been poured over and into the form, showing how the concrete has flowed through communication openings into the C channels of metal studs disposed in the foam form; and FIG. 7 is an enlarged view of the right side of the formed joist of FIG. 6 showing how the concrete has flowed into the main channel of the foam form, through a communication channel and into the C channel of the metal studs, thereby locking all of such elements together.

Elements in the figures are illustrated for simplicity and clarity and have not necessarily been drawn to scale. For example, the dimensions and/or relative positioning of some of the elements in the figures may be exaggerated relative to other elements to help to improve understanding of various embodiments of the present invention. Also, common but well-understood elements that are useful or necessary in a commercially feasible embodiment are often not depicted in order to facilitate a less obstructed view of these various embodiments of the present invention. Certain actions and/or steps may be described or depicted in a particular order of occurrence while those skilled in the art will understand that such specificity with respect to sequence is not actually required. The terms and expressions used herein have the ordinary technical meaning as is accorded to such terms and expressions by persons skilled in the technical field as set forth above except where different specific meanings have otherwise been set forth herein.

DETAILED DESCRIPTION

Figure 1:
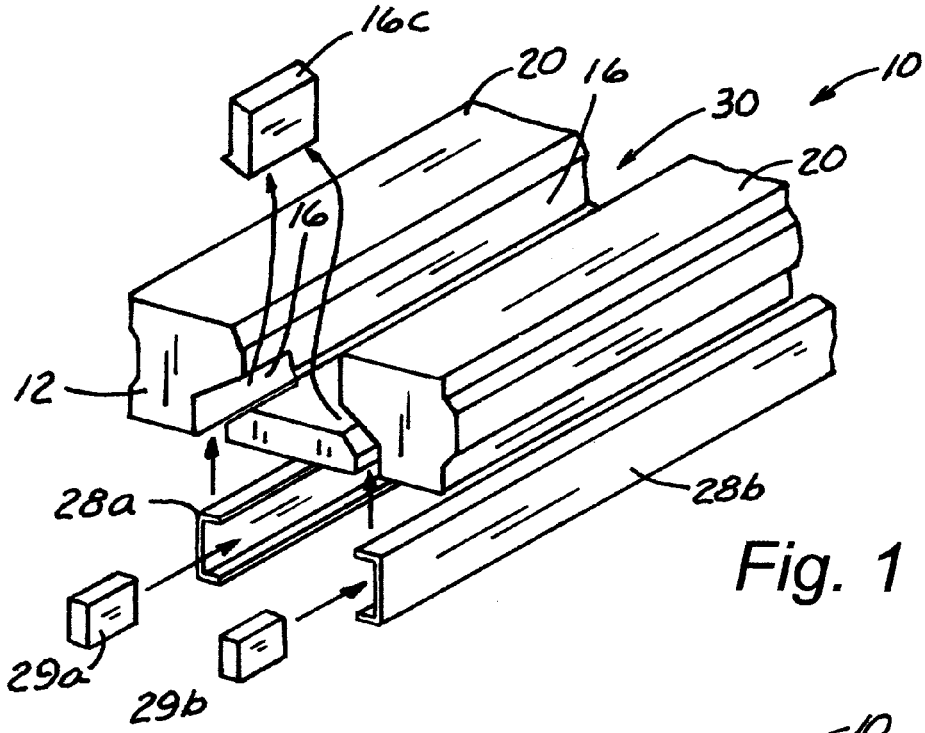
FIG. 1 is a perspective exploded view of the assembly and construction of a foam and metal C channel form of the present invention.

Referring now to the drawings, like reference numerals designate identical or corresponding parts throughout the several views, FIG. 1 shows the form system of the present invention generally at 10. Form panels 12 are typically interconnected side to side, and sometimes also from end to end, to form a continuous floor upon which concrete is poured and permitted to harden to form a continuous, insulated concrete deck for roofs and floors as can be seen to some extent in FIG. 6.

Figure 2:
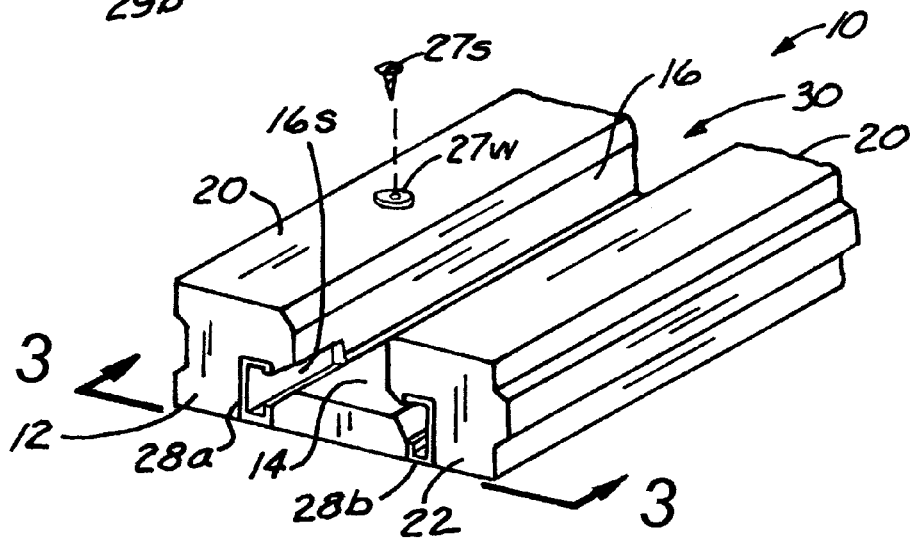
FIG. 2 is a perspective view of the assembled form shown in FIG. 1.

FIGS. 1 and 2 shows form panels 12 which are preferably formed from expanded polystyrene modified bead material. These foam panels 12 include a flat top face 20 and parallel bottom face 22. The typical panel 12 will have a depth, as measured from the top face to the bottom face, of about 6 inches, and a width measured from longitudinal side edge 24 to the opposing side edge 26 (FIGS. 5 and 6), of 4 feet. The length of each panel can be adjusted to the desired dimension of the job requirement by simply cutting any excess length from the panel.

Each panel 12 includes a plurality of C-shaped steel channel studs 28*a* and 28*b* extending from end to end, parallel to one another and side edges 24 and 26. Studs 28*a* and 28*b* are uniformly spaced apart and have one leg of the channel exposed substantially flush with the lower face 22 of the panel 12. Preferably, studs 22 are 18-gauge steel and spaced about 12 inches on center.

Referring again to FIG. 2, optionally, a plurality of screws 27*s* and washers 27*w* can be used to secure the foam panel 12 to the C channel studs 28*a* and 28*b*, wherein the screws 27*s* pass through the washers 27*w*, through a portion of the foam panel 12, and into the C channel studs 28*a*/28*b*.

Figure 3:
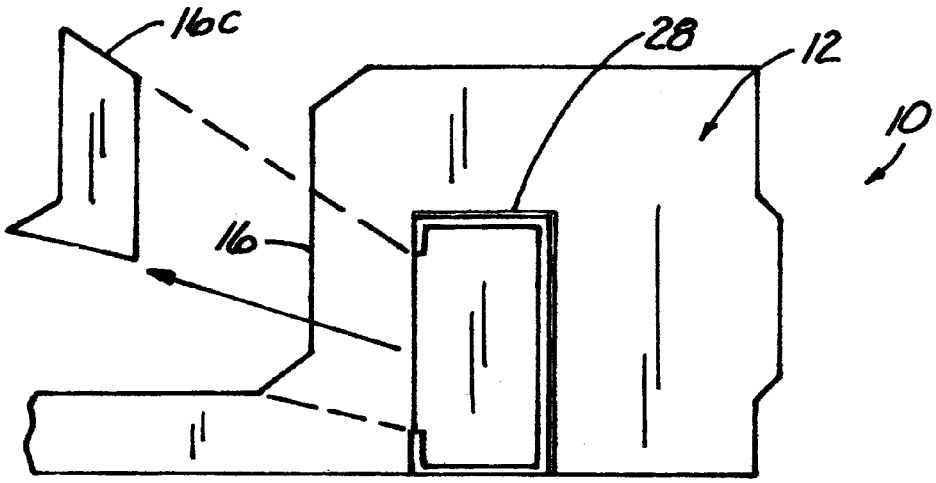
FIG. 3 is an end view of the right side of the joist of FIG. 2, showing how a portion of a channel wall, shown in dashed lines, looks before it is removed.
Figure 4:
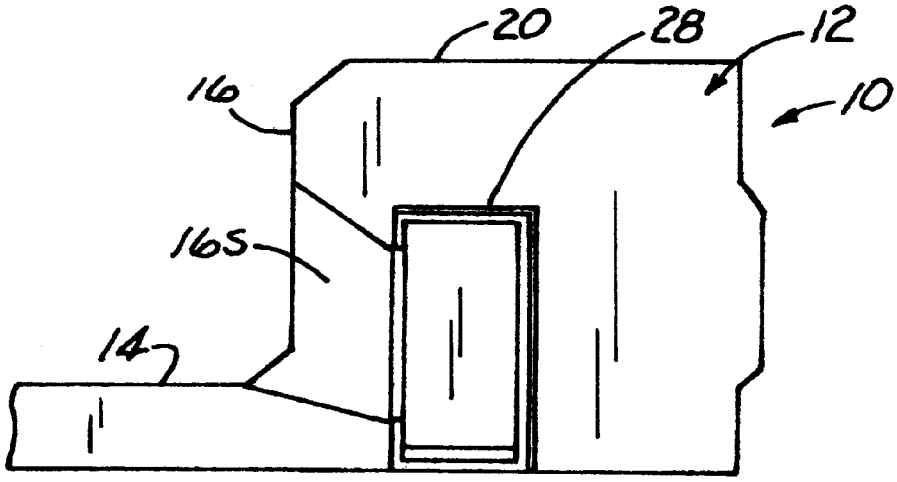
FIG. 4 is like FIG. 3, but shows the opening formed in the channel wall after the opening is removed.

FIG. 3 shows how a foam portion 16*c*, shown in dashed lines before foam portion 16*c* is cut out of the wall 16 of panel 12 and in solid lines exploded out of the dashed line opening. FIG. 4 shows a communication slot 16*s* disposed in wall 16 of panel 12 which is formed by removal of the foam portion 16*c*.

Figure 5:
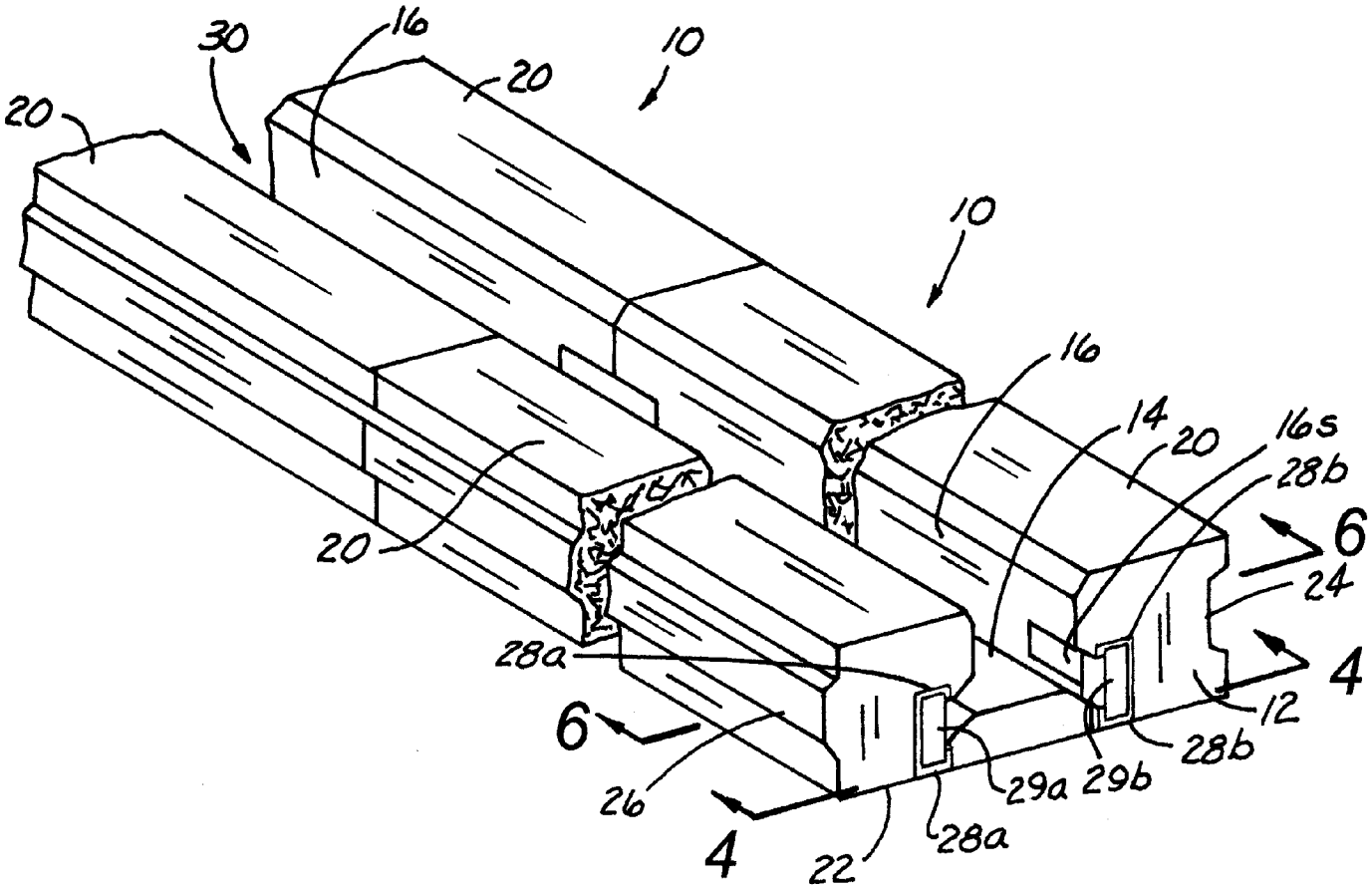
FIG. 5 is a perspective view of the present invention with two of the forms shown end to end in readiness to have concrete formed into and over the form.

FIG. 5 shows the form 10 ready to pour concrete into and on top of it, with foam stops 29*a* and 29*b* in the ends of C channels 28*a* and 28*b*. Foam stops 29*a* and 29*b* can be seen also in FIG. 1 before they are inserted into the ends of C channels 28*a* and 28*b*.

Looking now to FIGS. 6 and 7 which show the joist after the concrete 32 has been poured into a longitudinal slot 30 formed in the top face of panel 12 and over the top of flat portions 20 of the form 10. The concrete beam portion 32*c* extends in the slot 30 of the form from end to end in the panel, generally centrally between the two studs 28*a* and 28*b*. In a typical six-inch depth panel 12, the slot 30 would preferably have a depth of about 4 inches and a width of about 6 inches at the upper edges of the slot. A minimum 2 inch thick layer of concrete 32 is preferably poured over the top of the forms to integrally connect the T-joists 32 and form a concrete deck with a built-in structural support.

A perimeter wall 48 (shown in dashed lines in FIG. 6) is placed around the form system and projects upwardly beyond the top surface of the top surface 20 of panel 12, such that concrete poured over the form panel 12 will form a flat deck above the top surface of the panel thereby producing an integrated concrete T-joist interconnected with concrete disposed in the C-channel.

Still looking to FIGS. 6 and 7, it can be seen that the concrete flows through the communication slot 16*s*, where the foam part 16*c* has been removed, though the form 10 can be originally formed with the slot 16*s* in it. The concrete part 32*b* eventually hardens where slot 16*c* in the foam panel 10 is removed to allow concrete 32*c* to flow into and thereby harden inside of C channel 28*b*. Of course the flow happens in the C channel 28*a* of FIG. 6 with corresponding concrete parts 33*b* and 32*c*. FIG. 6 also shows that, optionally, foam expansion joint pieces 33 can be disposed inside of C channels 28*a* and 28*b*.

Those skilled in the art will recognize that a wide variety of modifications, alterations, and combinations can be made with respect to the above described embodiments without departing from the spirit and scope of the invention, and that such modifications, alterations, and combinations are to be viewed as being within the ambit of the inventive concept as expressed by the attached claims. For example, using a hole saw with an angle drill would be a fully equivalent alternate method of opening a hole for concrete to flow into the steel C channel and lock it to the C channel when the concrete hardens instead of pre-forming an opening in the foam form or cutting out a communication slot portion of the foam between the piers and the C channel in advance of pouring the concrete.

I claim:

1. A concrete form system, comprising:

at least a first elongated form panel having top and bottom surfaces, first and second ends, and opposing longitudinal side edges;

at least a first elongated slot formed in the top surface of the panel and extending from end to end, parallel to the side edges, said slot dividing the top surface of the panel into upstanding piers;

at least a second elongated slot formed in the panel, said second slot being substantially parallel to the first elongated slot;

a C-shaped steel channel stud disposed in the second elongated slot extending from end to end, parallel to one another and side edges, the C-shaped channel having an open portion along the length thereof; and a communication channel in at least one of the piers between the first elongated slot and the open portion of the C-shaped channel for permitting concrete in a pourable state to pass from the first elongated slot to the open portion of the C-shaped channel.

2. The concrete form system of claim 1, further comprising:

at least a third elongated slot formed in the panel, said second slot being substantially parallel to the first elongated slot;

a second C-shaped steel channel stud disposed in the third elongated slot extending from end to end in the other one of the piers, the second C-shaped channel having an open portion along the length thereof; and a second communication channel in the other one of the piers between the first elongated slot and the open portion of the second C-shaped channel for permitting concrete in a pourable state to pass from the first elongated slot to the open portion of the second C-shaped channel.

3. The concrete form system of claim 1, further comprising a perimeter wall formed around the form system and projecting upwardly beyond the top surface of the panel, such that concrete poured over the form panel will form a flat deck above the top surface of the panel forming an integrated concrete T-joist interconnected with concrete disposed in the C-channel.

4. The concrete form system of claim 1, wherein said panel comprises expanded polystyrene material.

5. A joist, comprising:

at least a first elongated form panel having top and bottom surfaces, first and second ends, and opposing longitudinal side edges;

at least a first elongated slot formed in the top surface of the panel and extending from end to end, parallel to the side edges, said slot dividing the top surface of the panel into upstanding piers;

at least a second elongated slot formed in the panel, said second slot being substantially parallel to the first elongated slot;

a C-shaped steel channel stud disposed in the second elongated slot extending from end to end, parallel to one another and side edges, the C-shaped channel having an open portion along the length thereof;

a communication channel in at least one of the piers between the first elongated slot and the open portion of the C-shaped channel for permitting concrete in a pourable state to pass from the first elongated slot to the open portion of the C-shaped channel; and concrete disposed between the piers, in the communication channel and in the C-shaped channel.

6. The joist of claim 5, further comprising:

at least a third elongated slot formed in the panel, said second slot being substantially parallel to the first elongated slot;

a second C-shaped steel channel stud disposed in the third elongated slot extending from end to end in the other one of the piers, the second C-shaped channel having an open portion along the length thereof;

a second communication channel in the other one of the piers between the first elongated slot and the open portion of the second C-shaped channel for permitting concrete in a pourable state to pass from the first elongated slot to the open portion of the second C-shaped channel; and concrete disposed in the second communication channel and in the second C-shaped channel.

* * * * *